US008860576B2

(12) United States Patent
Weller et al.

(10) Patent No.: US 8,860,576 B2
(45) **Date of Patent: *Oct. 14, 2014**

(54) INTEGRATED DOCUMENT HOLDER AND RFID TAG

(75) Inventors: John Charles Weller, Clear Brook, VA (US); Clayton Craig Bonnell, Fairfax, VA (US)

(73) Assignee: United States Postal Service, Washington, DC (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/615,397

(22) Filed: Sep. 13, 2012

(65) Prior Publication Data

US 2013/0001282 A1 Jan. 3, 2013

Related U.S. Application Data

(63) Continuation of application No. 13/084,487, filed on Apr. 11, 2011, now Pat. No. 8,742,928, which is a continuation of application No. 11/497,792, filed on Aug. 1, 2006, now Pat. No. 7,924,157.

(51) Int. Cl.
*G08B 13/14* (2006.01)
*B65D 27/00* (2006.01)

(52) U.S. Cl.
CPC ..... *B65D 27/00* (2013.01); *B65D 2203/10* (2013.01)
USPC ..... 340/572.1; 340/825.49; 340/10.1

(58) Field of Classification Search
USPC ..... 340/572.1, 825.49, 10.1, 539.1, 568.1, 340/572.2–572.9, 539.13, 5.61, 10.42, 10.4
See application file for complete search history.

(56) References Cited

U.S. PATENT DOCUMENTS

| | | | | |
|---|---|---|---|---|
| 3,625,546 | A | 12/1971 | Evans | |
| 3,628,266 | A | 12/1971 | Wise et al. | |
| 3,762,627 | A | 10/1973 | Ross et al. | |
| 4,153,163 | A | 5/1979 | Alderman et al. | |
| 5,197,761 | A * | 3/1993 | Shirdavani | 281/15.1 |
| 5,411,784 | A | 5/1995 | Brewster | |
| 5,706,935 | A | 1/1998 | Lorton | |
| 6,645,327 | B2 | 11/2003 | Austin et al. | |
| 6,729,468 | B1 | 5/2004 | Dobmeier | |
| 6,847,299 | B2 | 1/2005 | Franks | |
| 6,957,755 | B2 | 10/2005 | Mahoney et al. | |

(Continued)

FOREIGN PATENT DOCUMENTS

| | | |
|---|---|---|
| DE | 3238053 A1 | 4/1984 |
| EP | 1626009 A1 | 2/2006 |
| FR | 2078310 | 11/1971 |

OTHER PUBLICATIONS

International Search Report and Written Opinion for PCT/US2006/033765 dated May 15, 2007.

*Primary Examiner* — Daniel Previl
(74) *Attorney, Agent, or Firm* — Knobbe Martens Olson & Bear LLP

(57) ABSTRACT

An integrated document holder and RFID tag device is disclosed herein. The document holder may take the form of a shipping envelope which is affixed to an item and carries documents related to the item such as a packing list or shipping manifest. The device includes an RFID tag integrated into the shipping envelope which allows both the RFID tag and the shipping envelope to be affixed to the item in a single labor effort.

15 Claims, 5 Drawing Sheets

(56) References Cited

U.S. PATENT DOCUMENTS

| | | | | |
|---|---|---|---|---|
| 7,156,301 | B1 | 1/2007 | Bonalle et al. | |
| 7,212,123 | B2 | 5/2007 | Waters et | |
| 7,271,726 | B2 | 9/2007 | Hollon | |
| 7,336,167 | B2 | 2/2008 | Olsen et al. | |
| 7,336,243 | B2 | 2/2008 | Jo et al. | |
| 7,479,882 | B2 * | 1/2009 | Mahaffey | 340/572.3 |
| 7,672,872 | B2 | 3/2010 | Shanton | |
| 7,924,157 | B2 * | 4/2011 | Weller et al. | 340/572.1 |
| 2004/0017076 | A1 * | 1/2004 | Raming | 283/81 |
| 2004/0178109 | A1 | 9/2004 | Turner et al. | |
| 2005/0087978 | A1 * | 4/2005 | Tucker | 283/105 |
| 2005/0127157 | A1 * | 6/2005 | Stemmle et al. | 235/377 |
| 2006/0017573 | A1 | 1/2006 | Noguchi | |
| 2006/0065714 | A1 | 3/2006 | Jesme | |
| 2007/0090954 | A1 | 4/2007 | Mahaffey | |
| 2008/0109999 | A1 | 5/2008 | Lee-Holowka et al. | |

* cited by examiner

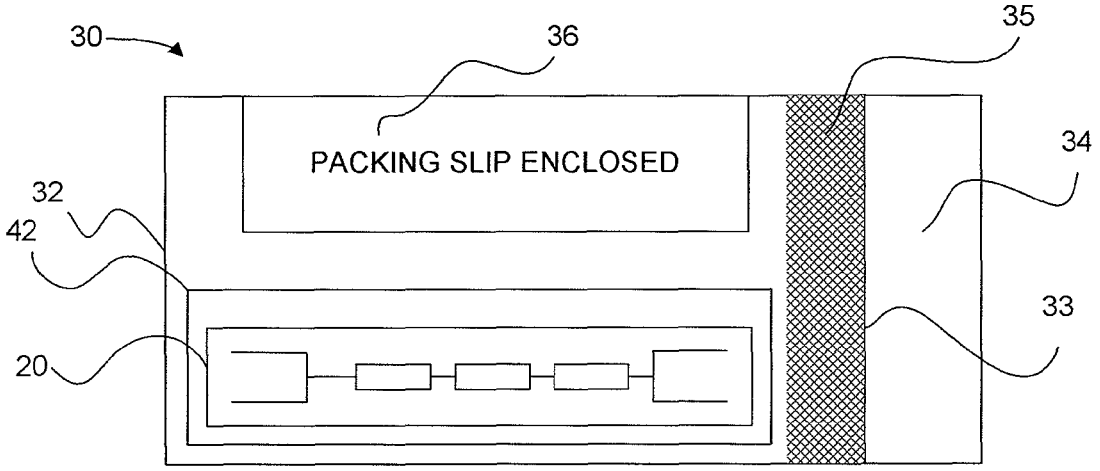
FIG. 4A
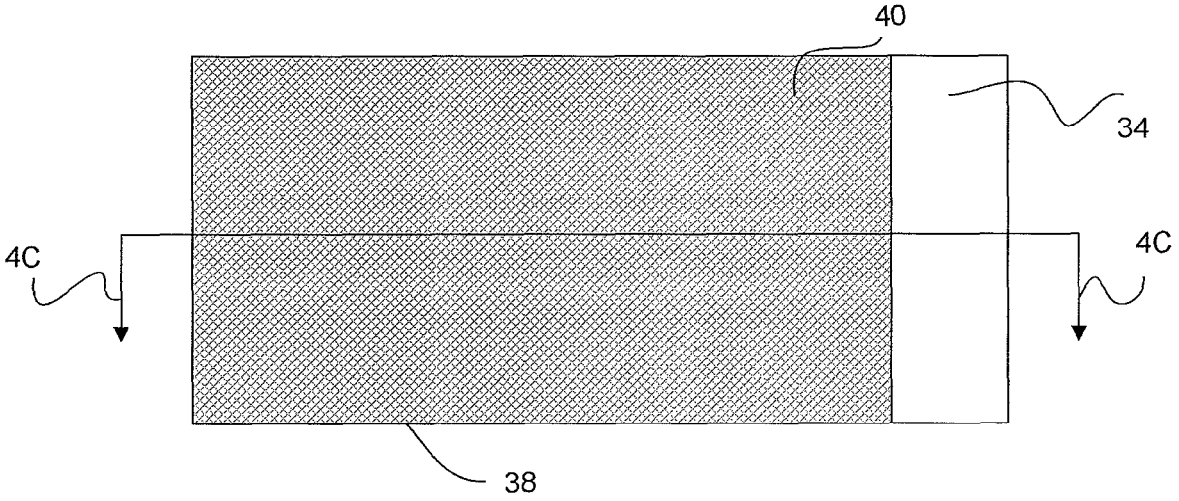
FIG. 4B
FIG. 4C
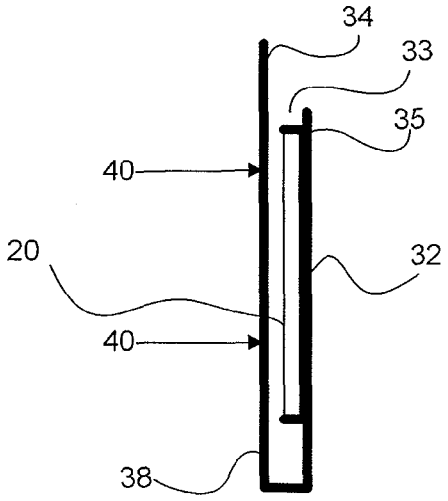

INTEGRATED DOCUMENT HOLDER AND RFID TAG

CROSS-REFERENCE TO RELATED APPLICATIONS

This application is a continuation of patent application Ser. No. 13/084,487, filed Apr. 11, 2011, which is a continuation of U.S. patent application Ser. No. 11/497,792, filed Aug. 1, 2006, the entire disclosures of both of which are incorporated by reference herein.

BACKGROUND OF THE INVENTION

1. Field of the Invention

This application relates to materials handling. In particular, this application relates to a system, method, and apparatus for tracking items in transit.

2. Description of the Related Art

Currently, when items are in transit between an origin and a destination location, external marking is generally placed on the items to provide information about the item. The information provided about the item by the external marking may be related to the contents or other attributes of the item (e.g., routing, type of handling necessary, etc.). These external markings and other documents are often enclosed in shipping envelopes that are affixed to the item. These shipping envelopes are typically applied by hand, and require a one-time labor effort performed the first time the item is handled during transit.

Recently, in order to improve the ability to track the location of items, newer tracking technologies have been developed. One of these technologies is radio frequency identification (RFID). RFID technology uses radio waves to obtain information regarding objects involved in the transit process. Electronic tags that carry unique identification and descriptive information are embedded in objects. These tags emit low-power radio frequency signals to RFID readers. RFID readers read RFID tags to obtain the information programmed within the tag's microchip. Readers emit electromagnetic waves from their antennas. Like shipping envelopes, RFID tags are typically affixed to units at the time of shipping, requiring another separate labor effort performed when the item begins its journey.

Thus, items having both shipping envelopes and RFID tags typically require an adhesive for both the shipping envelope and the RFID tag, and they further require two separate labor efforts to affix them both to the item. This duplication of effort and materials results in increased labor and materials costs. Thus, it would be useful to provide a materials handling solution that allows for the affixation of both RFID tags and shipping envelopes without an increase in materials cost or labor.

SUMMARY OF CERTAIN INVENTIVE EMBODIMENTS

The system, method, and devices of the invention each have several aspects, no single one of which is solely responsible for its desirable attributes. Without limiting the scope of this invention, several of its features will now be discussed briefly.

In one embodiment, an integrated document holder and RFID tag device is provided. The device may include a front layer and a substrate layer. The substrate layer may have an RFID inlay mounted in the substrate layer.

In another embodiment, the integrated document holder and RFID tag device includes a front layer having an RFID inlay. The RFID inlay may include an active RFID tag or a passive RFID tag. The device may further include a bottom layer which has an adhesive on its outer surface which allows the device to be affixed to an item.

In yet another embodiment, a method of tracking an item in a transportation network is provided. The method includes receiving the item into the transportation network and writing data regarding the item to an RFID tag. The RFID tag may be embedded in a document holder. The method further includes affixing the document holder to the item.

BRIEF DESCRIPTION OF THE DRAWINGS

In this description, reference is made to the drawings wherein like parts are designated with like numerals throughout.

FIG. 4A is a top plan view of an integrated document holder and RFID tag according to another embodiment.

FIG. 4B is a bottom plan view of the integrated document holder of FIG. 4A.

FIG. 4C is a cross-sectional side view of the integrated document holder taken along lines 4C-4C of FIG. 4B.

DETAILED DESCRIPTION OF EMBODIMENTS OF THE INVENTION

Certain embodiments of the invention provide for a device which includes an integrated document holder (such as a shipping envelope) and RFID tag. The integrated device allows materials handling personnel to affix both an RFID and a document holder to an item in a single labor effort.

As used herein, an item may generally refer to any article that may receive a shipping document and/or an RFID tag. Items may include envelopes, boxes, packages, bags, shipping tubes, or any other structures which are transported from an origin location to a destination location. Items further include larger articles that transport other items. For example, an item may be a tray, a carton, a pallet, a shipping container, or even a trailer. As used herein, a document holder is any structure used to hold, enclose, contain, and/or protect one or more documents. One well known example of a document holder is a shipping envelope. Shipping envelopes are durable envelopes which are typically affixed to the outside of an item and which may carry one or more pieces of paper that include information indicative of the contents of the item. Shipping envelopes may be made of various materials, including paper, plastic, or some specialized material such as Tyvek®. A shipping envelop may typically include a front portion which may be made of a transparent material that allows the contents of the envelope to be viewed without breaking the envelope seal.

A shipping envelope may also include a back portion. The back portion, which will be alternatively referred to herein as the substrate portion, may include an adhesive material on its underside that allows the envelope to be affixed to an item by pressing the adhesive against the item, or by some other affixing procedure.

Figure 1:
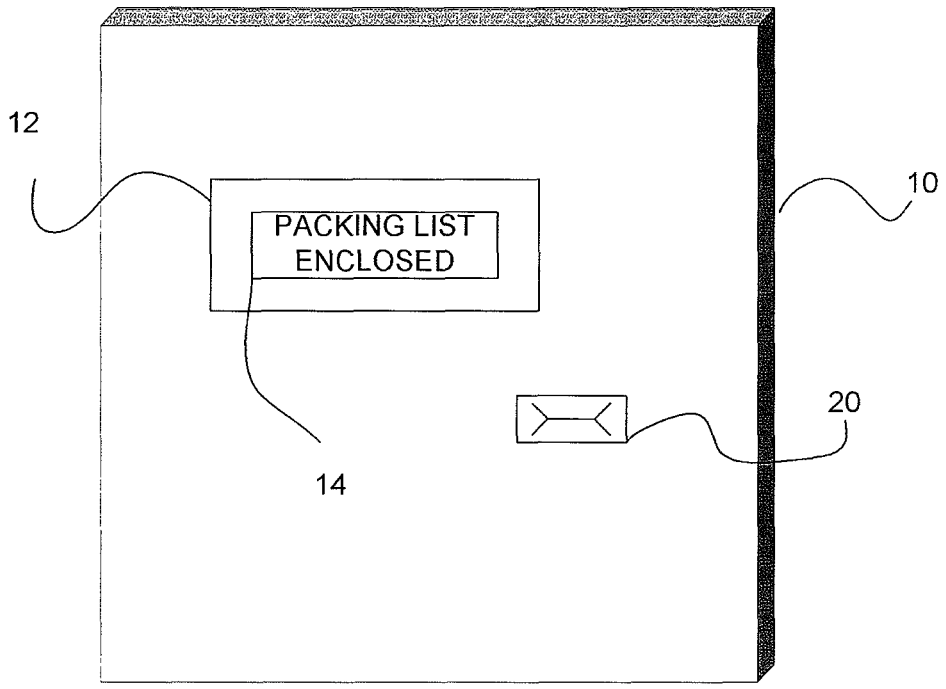
FIG. 1 is a perspective view of an item having a shipping envelope and a RFID affixed separately as is known in the art.

Existing RFID and labeling solutions require two separate affixation efforts in order to provide a secured document holder and a RFID tag on an item. FIG. 1 provides an example of an existing materials handling solution for affixing RFID tags and document holders to an item. With reference to the figure, an item 10 is provided. In the example provided, the item is a box which may contain materials that are in transit to a location. Affixed to the side of the shipping box 10 is a document holder 12. The document holder 12 in this example is a shipping envelope. The shipping envelope 12 has been affixed to the shipping box by a "slap and ship" process by which a person "slaps" the envelope 12 against the side of the box 10 resulting in the adhering material on the underside of the substrate becoming affixed to the box 10, thus securing the envelope 12 to the box 10. Inside the shipping envelope, there is a packing list 14. The packing list 14 has been inserted into the shipping envelope 12, and lists the materials included in the shipping box 12. The shipping box 10 also has an RFID label 16 affixed to its outer wall. The RFID label 16 may be an adhesive label that includes an RFID tag which has been printed and encoded by an RFID printer. The RFID label 16 has also been "slapped" onto the exterior of the box 10 in an affixing effort that is separate from and additional to the affixing effort described above in relation to the label holder 12.

Figure 2:
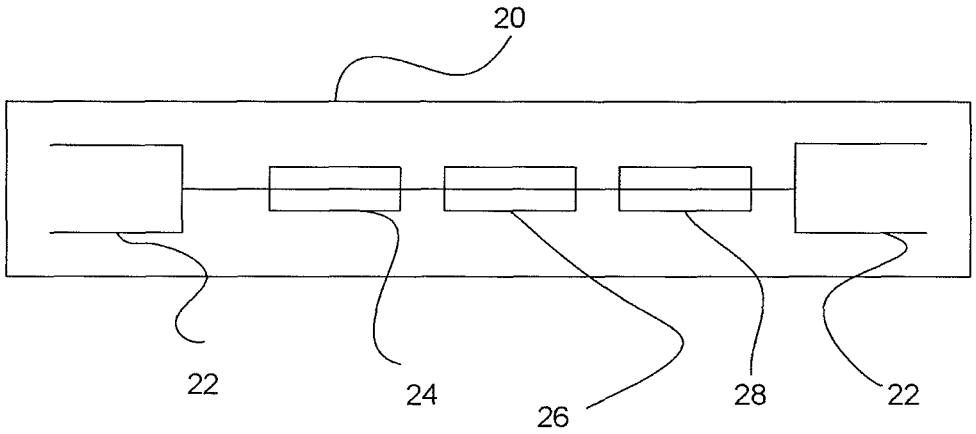
FIG. 2 is a plan view of a RFID tag.

As noted above, certain aspects of the invention provide for integrating the use of RFID tags with document holders. Those of skill in the art will appreciate that there are various types of RFID tags and technology available, and that the specific implementations described herein are not intended to limit the scope of the invention. Any type of RFID tag having any type of frequency may be suitable for practicing various embodiments described herein. FIG. 2 provides an example of an RFID tag 20 which may be integrated with a document holder in a manner that will be described in further detail below. The RFID tag 20 may be an active RFID tag which transmits RF signals without the aid of an external power source, or a passive RFID tag which uses an incoming radio frequency signal to power up and transmit a response. The RFID tag 20 may also be semi-passive, in that it may include a small battery that allows the tag to be constantly powered, thus removing the need for an antenna to collect power from the incoming signal.

As shown in FIG. 2, the RFID tag 20 may include one or more antennae 22. The antennae 22 are used to transmit and receive signals from the RFID tag to external devices. The RFID tag 20 may further include a power source 24. The power source 24 may be a battery that is typically used in conjunction with active RFID tags. In some instances, the power source 24 may allow the RFID tag 20 to transmit a signal without requiring power from the external device by providing the necessary power to the tag device. The RFID tag 20 may further include an integrated circuit (IC) 26. The IC 26 may be a computer chip which, upon receiving power from either the power source 24 or from an RFID reader which provides the necessary power, transmits data out of the RFID tag 20 through the antennae 22. In one embodiment, the IC may be a silicon-based chip. Other types of chips such as gallium-arsenide or silicon-germanium based chips may also be used. In addition, chipless RFID tags that do not include an IC may also be used. For example, in one embodiment, the RFID tag may include acoustomagnetic, swept RF inductor capacitor arrays. Alternatively, the RFID tag may be formed of electromagnetic RF sputtered film. Chipless RFID tags may also be in the form of diode arrays, surface acoustic wave devices, and/or chemicals that emit high frequencies when moved. RFID tags may also be formed with Thin Film Transistor Circuits (TFTCs). The RFID tag 20 may further include a memory 28 which may store data. The memory 28 may be a nonvolatile electrically erasable programmable read-only memory (EEPROM) which can be written to and read by the IC 26.

Figure 3A:
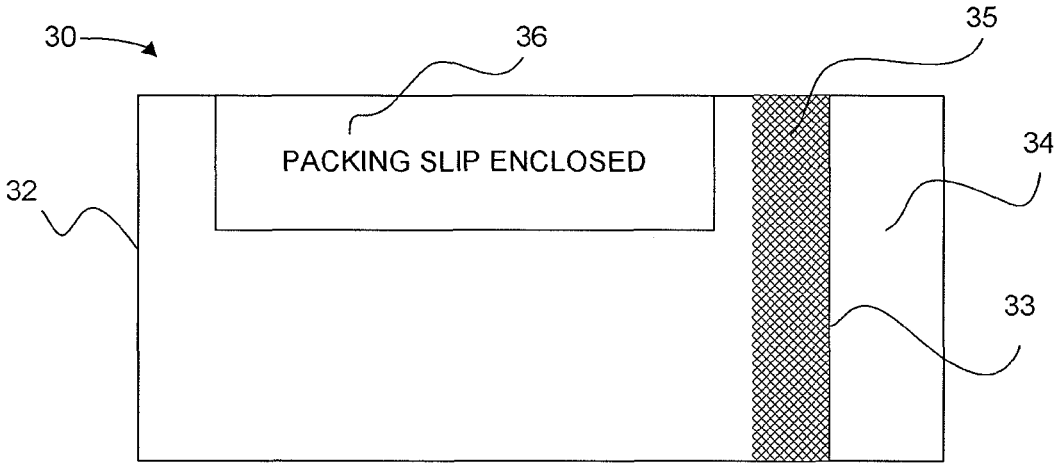
FIG. 3A is a top plan view of an integrated document holder and RFID tag according to one embodiment.
Figure 3B:
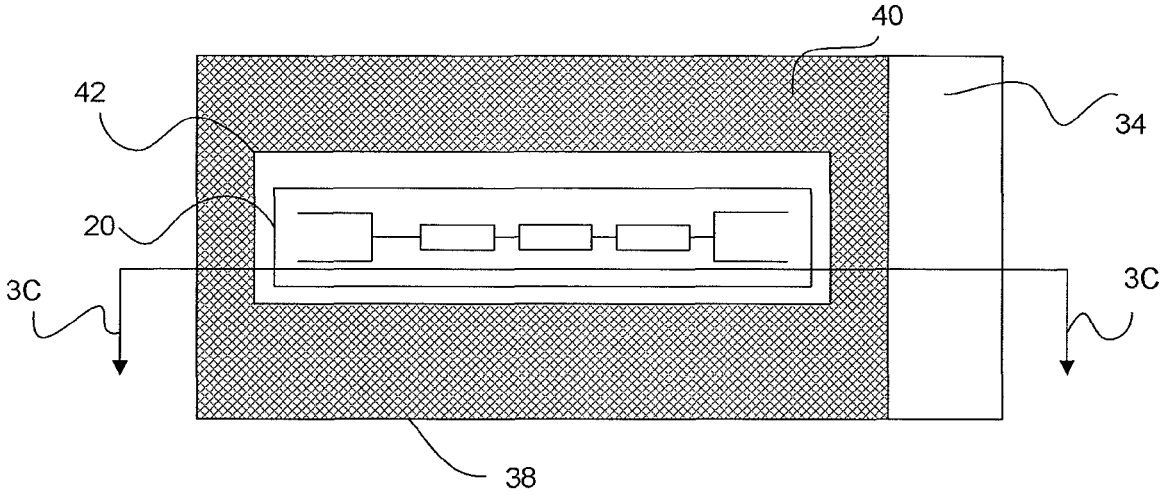
FIG. 3B is a bottom plan view of the integrated document holder and RFID tag of FIG. 3A.
Figure 3C:
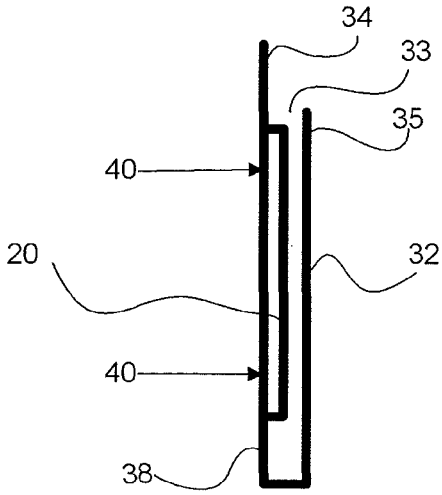
FIG. 3C is a cross-sectional side view of the integrated document holder and RFID tag taken along lines 3C-3C of FIG. 3B.

FIGS. 3A-3C illustrate an example of an integrated document holder and RFID tag which includes features of the RFID tag 20 and the shipping envelope 12 described in relation to FIG. 1 above. FIG. 3A illustrates the front of an integrated document holder and RFID tag 30 according to one embodiment. The integrated document holder and RFID tag 30 (hereinafter referred to as "integrated tag/envelope") includes a front layer 32 and a back (or substrate) layer 38 (not shown in FIG. 3A). At one end of the front layer is an opening 33 between the front layer 32 and the substrate 38 which allows insertion of materials such as shipping manifest, packing lists, or some other documents. The front layer 32 may also include sealing adhesive material 35 located on an area of the front layer 32 which receives a sealing flap 34 into contact when the sealing flap 34 is folded over. The sealing adhesive material 35 holds the sealing flap 34 in place to seal the integrated tag/envelope 30. The sealing flap 34 may form a portion of the substrate layer 38. Although in the embodiment the contents of the envelope are secured by sealing adhesive material 35 and the sealing flap 34, other embodiments may not include the sealing flap or adhesive material. For example, in some embodiments, the envelope may be closed by a Velcro® securing mechanism. In another embodiment, the opening may be closed by some zipper-type mechanism. The front layer 32 may also include some markings or indicia 36 on the front layer 32 which may provide an indication of the contents of the tag/envelope 30. In the embodiment illustrated in FIG. 3, the tag/envelope is a shipping envelope that includes a packing list. Thus, the marking 36 indicates that a packing slip is enclosed within the integrated tag/envelope 30.

Referring now to FIG. 3B, the substrate layer 38 of the integrated tag/envelope 30 may be described. The substrate layer 38 may include an affixing adhesive 40 located on its underside which may be used to affix the integrated tag/envelope 30 to an item 10 when pressure is applied against the front layer 32 to press the adhesive material 40 against the item 10. Mounted in the substrate layer 38 is an RFID inlay 42. As used herein the term "mounted" includes its general meaning, and further incorporates embedded, fastened, glued, screwed, soldered, and/or sealed. As particular example, in one embodiment, the inlay is adhered using glue or epoxy during the manufacturing process. Alternatively, the inlay may be bonded to the substrate material during the formation of the substrate using a thermal or chemical bonding process. In addition, mechanical processes may be used, including a crimping mechanism placed in the substrate which secures the inlay. The RFID inlay 42 includes an RFID tag 20 which may be encoded with information about the item 10 to which the tag/envelope 30 is affixed. In some embodiments, the RFID inlay 42 may be connected to the substrate layer 38 via a perforated edge allowing the RFID inlay 42 to be separated from the remainder of the tag/envelope 30 by tearing it from the RFID inlay. Thus, in certain embodiments, the RFID inlay may be permanently affixed to the item 10, while the remainder of the tag/envelope 30 may be removed without damaging the inlay 42.

In certain embodiments, a backer sheet may be provided to cover the adhesive material 40 prior to application of the integrated tag/envelope 30 to an item. The backer sheet may be removed by pealing it off prior to application. The backer sheet may allow rolling or stacking of multiple unused integrated tag/envelopes 30 by preventing them from adhering to each other.

FIG. 3C provides a cross section side view of the integrated tag/envelope 30 stood upright on the edge opposite the opening 33. The front layer 32 is shown on the right side of the drawing with the marking 36 positioned in a centered position on the front layer 32. In some embodiments, the marking 36 may be positioned elsewhere, such as on an edge of the front layer 32. On the left side of FIG. 3C is the substrate layer 38 which includes the affixing adhesive 40 on its underside. The gap between the substrate layer and the front layer 32 forms the opening 33 for receiving contents such as documents. Also shown in FIG. 3C is the RFID inlay 42 mounted into the substrate layer 38, with the RFID tag 20 positioned within the inlay 42. On the top outer surface of the front layer 32 is the sealing adhesive 35. The sealing flap 34, which forms the upper portion of the substrate layer 38 (and may in some embodiments also include adhesive material) may fold over to the sealing adhesive 35 to close the integrated tag/envelope 30.

Referring now to FIGS. 4A-4C, an alternative integrated tag/envelope 30 is provided. This particular embodiment, while similar to that described in relation to FIG. 3, is configured with the RFID inlay 42 and associated RFID tag 20 mounted or embedded in the front substrate layer 22 rather than the back layer 38. FIG. 4A provides a top plan view of the front of the alternative integrated tag/envelope 30. The alternative tag/envelope 30 includes a front layer 32. One end of the front layer 32 forms an opening 33 between the front layer 32 and the back layer 38. A portion of the back layer 38 may extend beyond the opening 33 to form a sealing flap 34. The front layer 32 may also include sealing adhesive material 35 which may receive the flap 34 to seal the tag/envelope 30. Also part of the front layer 32 is a RFID inlay 42. The RFID inlay 42 includes an RFID tag 20. The front layer 32 may also include marking 36 to indicate the contents of the tag/envelope 30.

FIG. 4B provides an illustration of the back layer 38 of the alternative integrated tag/envelope 30. Unlike the embodiment described in FIG. 3 above, the back layer 38 in FIG. 4B does not include an RFID inlay. Rather, the back layer 38 includes an affixing adhesive 40 located on the underside of the envelope which may be used to affix the tag/envelope to an item 10.

Referring now to FIG. 4C, a cross-section side view illustrates the alternative integrated tag/envelope 30 when the tag/envelope 30 is stood upright on the edge opposite the opening 33. The front layer 32 is shown on the right side of the drawing with the marking 36 positioned in a centered position on the front layer 32. The RFID inlay 42 is mounted on the front layer 32 which serves as the substrate for the RFID inlay 42. The RFID tag 20 components are positioned within the inlay 42. On the left side is the back layer 38 of the tag/envelope 30 which includes the affixing adhesive 40 on its underside. The gap between the front layer 32 and the back layer 38 forms the opening 33 for receiving documents or other materials. Although the front layer 32 and back layer 38 are described in the illustrated embodiment as separate pieces, in certain embodiments, the opening 33 may be formed by a single contiguous layer which may include front and back areas. Thus the terms front layer and back layer include reference to at least a portion of the layer located in front of the opening and in back of the opening, respectively. On the top outer surface of the front layer 32 is the sealing adhesive 35. The sealing flap 34, which forms the upper portion of the back layer 38 (and may in some embodiments also include adhering material) may fold over to the sealing adhesive 35 to close the integrated tag/envelope 30. In various embodiments the integrated tag/envelopes described in FIGS. 3A-3C and 4A-4C may be affixed to various types of items to allow for efficient tracking and identification of the items 10 as they are in transit. Depending on the type of item 10 to which the tag/envelope 30 is affixed, one or the other embodiment may be better-suited for achieving the objectives of the shipping entity.

Figure 5:
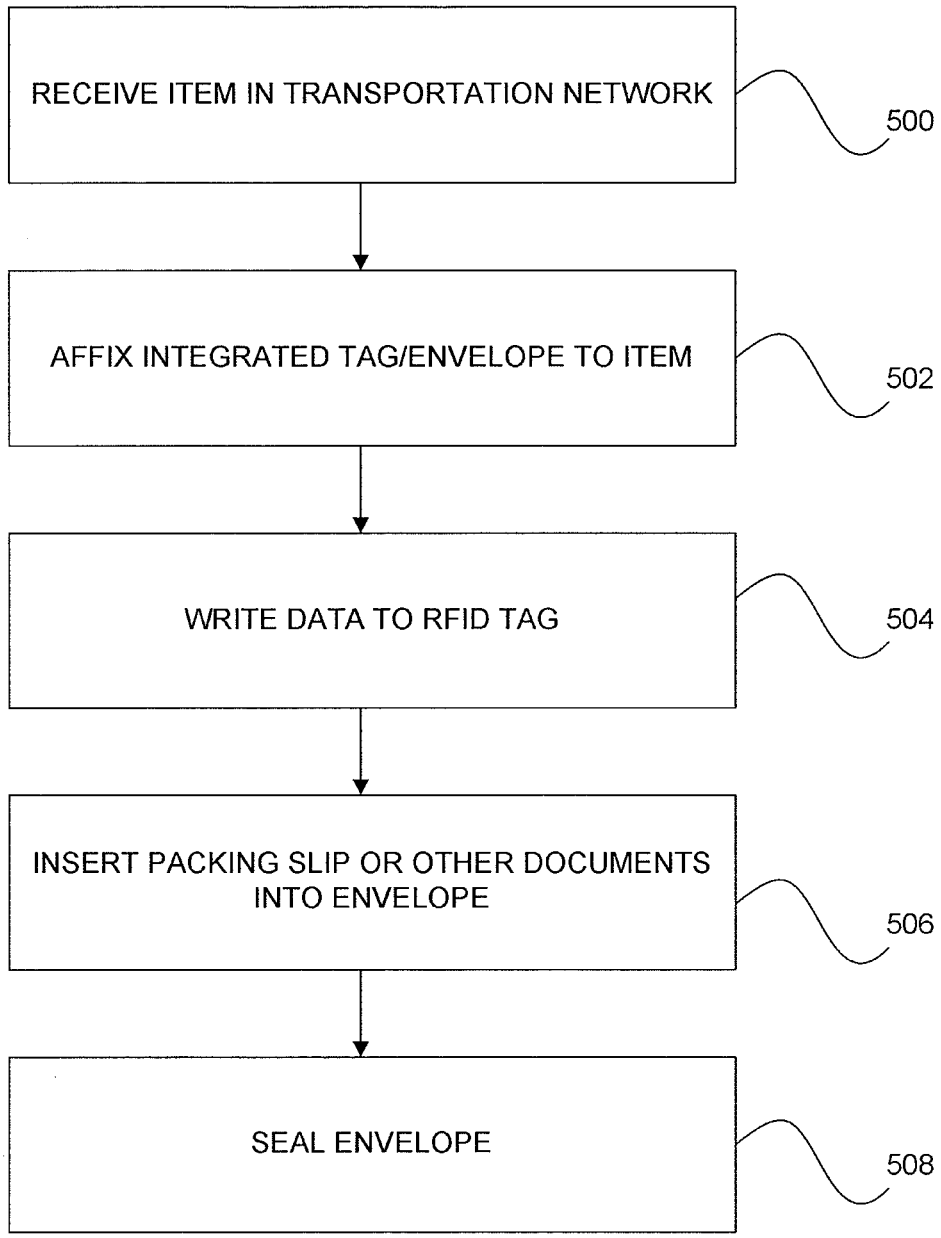
FIG. 5 is a flowchart illustrating a method for tracking an item in a transportation network.

FIG. 5 is a flowchart that illustrates a process for tracking items within a transportation network. The process begins at block 500 where an item is received into the transportation network environment. Next at block 502, an integrated tag/envelope 30 is affixed to the item. Next, at block 504, data is written to the RFID tag 20 portion of the integrated tag/envelope 30 including information about the item or its contents. In some embodiments, the data written to the RFID tag 20 may be provided by an RFID reading/writing device such as, for example, a JETT•RFID™ reader from Two Technologies Inc of Horsham, Pa. The data may include a record identifier which may be used to link the item to a more detailed record that is stored in a database on an external computing device. The data on the RFID tag 20 may be linked to the database via a middleware application running on the reading/writing device. Alternatively, the RFID tag 20 may include a memory that allows additional information such as a list of the contents of the item, its routing information, or some other information to the stored on the RFID tag to be easily accessible without the needing to query an external database. Next, at block 506, a piece of paper including information about the item is placed inside of the integrated tag envelope. The process then moves to block 508, where the integrated tag/envelope 30 is sealed with the paper inside.

Figure 6:
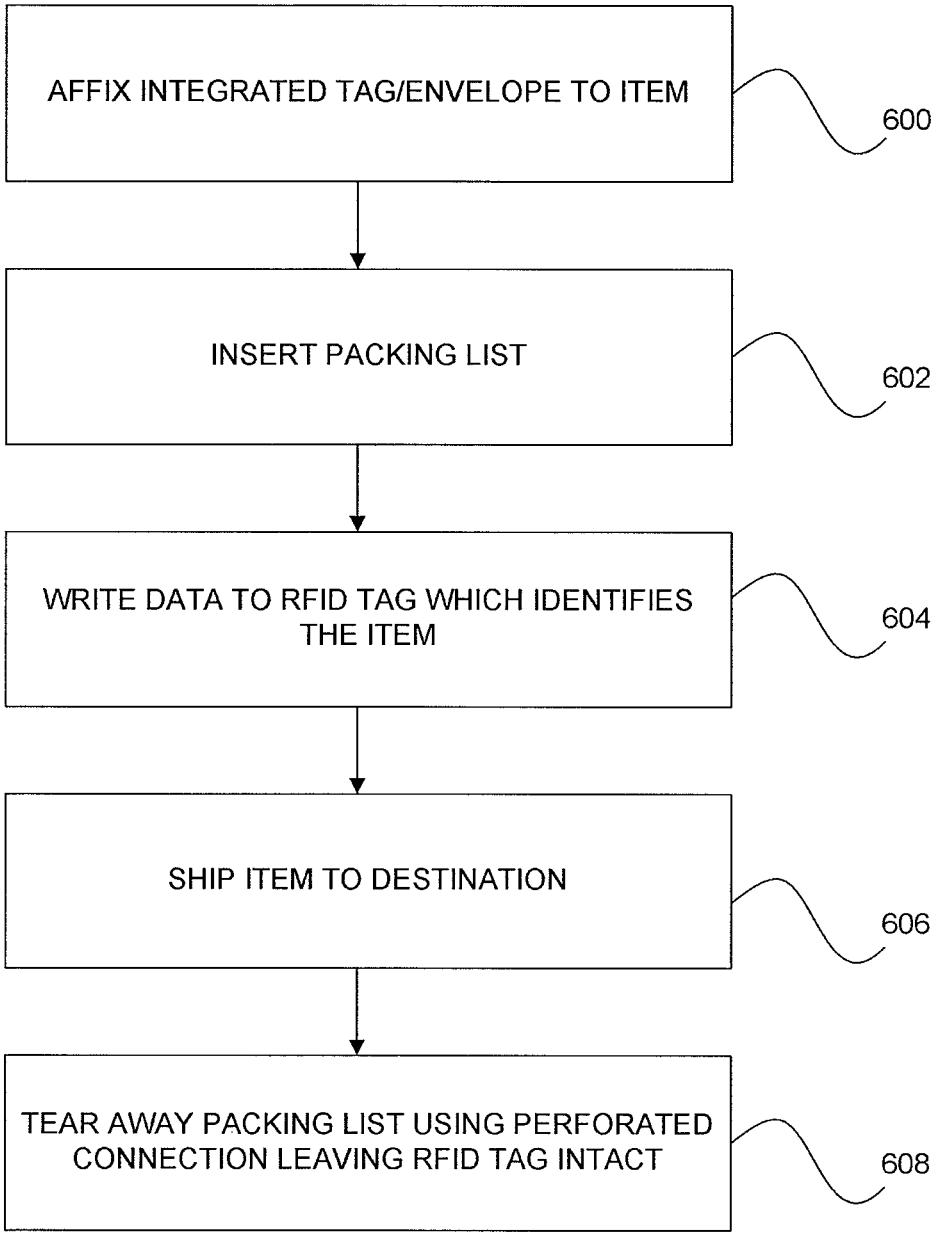
FIG. 6 is a flowchart illustrating a method for utilizing an integrated tag/envelope to provide non-permanent and permanent information about an item.

FIG. 6 provides an illustration of a process for utilizing an integrated tag/envelope 30 to provide non-permanent packing list information for an item from an origin to a destination, while at the same time providing a more permanent "license plate"-type identifier for the item utilizing the features of the RFID inlay. The process begins at block 600 where an integrated tag/envelope 30 is affixed to an item. At block 602, a packing list is inserted into the opening 33 of the integrated tag/envelope 30. Next, the process moves to block 604 where the RFID tag is written with data identifying the item itself, as opposed to the content carried by the item. This data may include a unique identifier or some other identifying data. At block 606, the item is shipped from its origin to its destination. Upon arriving at the destination the front layer 32 of the envelope is removed by tearing it away from the substrate layer 38 at block 608. The removal may be facilitated by a perforated connection between the front layer 32 and the substrate layer 38. This process may be especially useful when the item 10 is a larger item such as a container or a trailer that is used to transport smaller items such as boxes and packages. It may be useful to provide a permanent "license plate" marking of the container or trailer using the RFID tag 20, but because the contents of the trailer will change after each delivery, the packing list and the shipping envelope should be removed. In subsequent shipments a packing list alone may be applied to the item. A new RFID tag 20 is not necessary, as the RFID tag 20 remains affixed to the item.

It will be understood by those of skill in the art that numerous and various modifications can be made without departing from the spirit of the present invention. Therefore, it should be clearly understood that the forms of the invention are illustrative only and are not intended to limit the scope of the invention.

What is claimed is:

1. An item delivery system comprising:
an item; and
a document holder adhered to the item, the document holder comprising:
a first side having a back and comprising:
an adhesive layer located on the back of the first side; and
an RFID tag embedded within the first side; and
a second side positioned opposite to the first side, wherein a portion of the first side is connected to a portion of the second planar side so as to define a receiving volume and an opening allowing access to the receiving volume;
a sealing flap extending from the first side, the sealing flap configured to fold over to contact the second side the sealing flap closing the opening when the sealing flap is folded over to contact the second side.

2. The system of claim 1, further comprising a backer sheet configured for removable adherence to the adhesive layer.

3. The system of claim 2, wherein the backer sheet is peelably removable from the adhesive layer.

4. The system of claim 1, wherein the document holder comprises a sealing layer located on the second planar side.

5. The system of claim 4, wherein the sealing layer is configured to seal the opening.

6. The system of claim 1, wherein the sealing flap can be moved from a first open position to a second sealed position.

7. The system of claim 6, wherein the sealing flap sealingly engages with the sealing adhesive when the sealing flap is in the second sealed position.

8. The system of claim 1, wherein the second planar side comprises an indication of the contents of the receiving volume.

9. A method of using a document holder to track items, the method comprising;
receiving an item;
affixing a document holder to the item, the document holder comprising:
a first side having a back and comprising:
an adhesive layer located on the back of the first side; and
an RFID tag embedded within the first side; and
a second side positioned opposite to the first side, wherein a portion of the first side is connected to a portion of the second side so as to define a receiving volume and an opening allowing access to the receiving volume; and
a sealing flap extending from the first side, the sealing flap configured to fold over to contact the second side;
sealing the opening by folding the sealing flap from a first open position to a second sealed position; and
associating the RFID tag with the item.

10. The method of claim 9 further comprising removing a backer sheet from the adhesive layer located on the back of the first planar side.

11. The method of claim 10, wherein the backer sheet is peeled from the adhesive layer.

12. The method of claim 9, further comprising placing an item in the receiving volume.

13. The method of claim 12, wherein the second side comprises an indication of the contents of the receiving volume.

14. The method of claim 9, wherein the sealing flap sealingly engages with the sealing adhesive when the sealing flap is in the second sealed position.

15. The method of claim 9, wherein associating the RFID tag with the item comprises writing a record identifier to the RFID tag, wherein the record identifier identifies a record in a database.

* * * * *